US007694971B2

(12) United States Patent
Sorge

(10) Patent No.: US 7,694,971 B2
(45) Date of Patent: Apr. 13, 2010

(54) ROULETTE GAME APPARATUS AND METHOD

(76) Inventor: Nicholas Sorge, 7 Susan Ct., Deer Park, NY (US) 11729

( * ) Notice: Subject to any disclaimer, the term of this patent is extended or adjusted under 35 U.S.C. 154(b) by 228 days.

(21) Appl. No.: 11/725,073

(22) Filed: Mar. 15, 2007

(65) Prior Publication Data

US 2008/0224393 A1 Sep. 18, 2008

(51) Int. Cl.
*A63F 5/00* (2006.01)

(52) U.S. Cl. ..... 273/274; 273/142 E; 273/138.1; D21/375

(58) Field of Classification Search ..... 273/274, 273/142 E, 142 F, 142 G, 142 H, 142 HA, 273/138.1; 463/17; D21/375
See application file for complete search history.

(56) References Cited

U.S. PATENT DOCUMENTS

| | | | | |
|---|---|---|---|---|
| D92,059 | S | 4/1934 | Anderson | |
| D106,967 | S | 11/1937 | Danon | |
| 3,248,116 | A | 4/1966 | Pawelka et al. | |
| 4,077,631 | A | 3/1978 | Tela, Sr. | |
| 4,984,796 | A * | 1/1991 | Peacock | 273/142 E |
| 5,540,442 | A | 7/1996 | Orselli | |
| 5,636,838 | A | 6/1997 | Caro | |
| 6,047,965 | A | 4/2000 | Mollo et al. | |
| 6,059,659 | A * | 5/2000 | Busch et al. | 463/17 |
| 6,186,892 | B1 * | 2/2001 | Frank et al. | 463/19 |
| 6,227,542 | B1 * | 5/2001 | Cosmi | 273/142 E |
| 6,302,395 | B1 * | 10/2001 | Astaneha | 273/274 |
| 6,352,260 | B1 | 3/2002 | Santiago | |
| 6,406,021 | B1 | 6/2002 | Nadibaidze | |
| 6,406,022 | B1 | 6/2002 | Nadibaidze | |
| 2003/0094752 | A1 | 5/2003 | Mathews | |
| 2005/0192076 | A1 | 9/2005 | Lowery | |
| 2005/0192079 | A1 | 9/2005 | Lowery | |
| 2006/0009274 | A1 | 1/2006 | Finocchio | |
| 2007/0222145 | A1 | 9/2007 | Sorge | |
| 2007/0222146 | A1 | 9/2007 | Sorge | |

OTHER PUBLICATIONS

Edward, Allen J., "The Basics of Winning Roulette", Cardoza Publishing, c2002, ISBN: 1-58042-059-1. Chapter II, American Roulette; p. 8-16, especially p. 11-16655552.
U.S. Appl. No. 11/787,473.
U.S. Appl. No. 11/393,322.
U.S. Appl. No. 11/329,197.

* cited by examiner

*Primary Examiner*—Benjamin H Layno
(74) *Attorney, Agent, or Firm*—Scully, Scott, Murphy & Presser, P.C.

(57) ABSTRACT

A method for arranging indicia on a game surface and on an associated roulette wheel. Indicia indicating numbers from 1 through 60 are arranged on the game surface in ascending order with half of the numbers associated with a first color and half associated with a second color. The numbers are arranged in three groups of twenty, each group having five even numbers and five odd numbers associated with each of the two colors. Indicia indicating each of the numbers are arranged on a roulette wheel such that no two adjacent numbers on the roulette wheel are associated with a same color, are disposed in a same group, are disposed in a same column, are disposed in a same row, or are disposed adjacent one another on the game surface.

17 Claims, 8 Drawing Sheets

ROULETTE GAME APPARATUS AND METHOD

BACKGROUND OF THE INVENTION

The invention relates to apparatuses for playing roulette and methods for arranging indicia on roulette game surfaces and roulette wheels.

Roulette is a well-known game of chance enjoyed throughout the world. The equipment used for playing roulette generally comprises a roulette wheel and a game surface.

The roulette wheel generally comprises a horizontally disposed wheel mounted in a bowl-shaped housing. The wheel is adapted to rotate about a vertical axis and includes a plurality of pockets disposed around its periphery. Each pocket has a unique number associated with the pocket, as well as a color associated therewith. Each pocket is adapted to receive a small ball which is introduced into the bowl shaped housing by an operator or croupier as the wheel is set in motion. The wheel is typically spun in one direction and the ball projected around the circumference of the housing in an opposite direction. As the ball loses speed, it rolls down the concave housing wall, eventually coming to rest in one of the pockets. The outcome or result of the spin is the number and color associated with the pocket in which the ball comes to rest.

The game surface includes a plurality of wagering areas indicating various numbers, colors, parities (the odd or even quality of a number) and groupings of numbers. One or more players make wagers on a predicted outcome of a spin of the roulette wheel. A players indicates his or her wager by placing one or more wagering devices, such as chips or markers representing an amount of the wager, at a predetermined location on the game surface corresponding to a predicted outcome of a spin of the roulette wheel.

A prior art roulette game surface or board is shown in FIG. 1. As shown the game surface includes wagering areas corresponding to the individual numbers 1 through 36. The numbers are arranged sequentially in three columns of twelve numbers each and twelve rows or streets of three numbers each. Eighteen of the numbers (1, 3, 5, 7, 9, 12, 14, 16, 18, 19, 21, 23, 25, 27, 30, 32, 34 and 36) correspond to a first color, typically red, and the remaining eighteen numbers (2, 4, 6, 8, 10, 11, 13, 15, 17, 20, 22, 24, 26, 28, 29, 31, 33 and 35 correspond to a second color, typically black. In the prior art arrangement, there are eight even red numbers (12, 14, 16, 18, 30, 32, 34 and 36), ten odd red numbers (1, 3, 5, 7, 9, 19, 21, 23, 25, and 27), ten even black numbers (2, 4, 6, 8, 10, 20, 22, 24, 26 and 28) and eight odd black numbers (11, 13, 15, 17, 29, 31, 33 and 35).

A player may place a wager on a particular number by placing one or more chips or markers within the wagering area corresponding to that number. In addition, players can wager on groupings of individual numbers. For example, a player can wager on a column of numbers by placing one or more chips or markers adjacent to the column of numbers, on a row of numbers by placing one or more chips or markers adjacent to the row of numbers, on two rows of numbers by placing one or more chips or markers adjacent to the two rows of numbers, and on four adjoining numbers by placing one or more chips or markers at the intersection of the four adjoining numbers.

As shown in FIG. 1, wagering areas are also typically provided for betting on the number 0 (and/or the number 00 in an American style wheel as described more fully herein), on a particular color outcome (for example red or black), on an even or odd number outcome, on an outcome comprising a number from 1 to 18, on an outcome comprising a number from 19 to 36 and on a particular set or block of numbers (for example first twelve number 1 through 12, second twelve numbers 13 through 24 or last twelve numbers 25 through 36).

Winning wagers in the game of roulette are paid out at predetermined multiples based on the probability of the particular predicted outcome. For example, a winning wager for an individual number may pay out at a ratio of 35 to 1; a winning wager for a row of three numbers may pay out at a ratio of 11 to 1; a winning wager for a group of four adjacent numbers may pay out at a ratio of 8 to 1; a winning wager for two adjacent rows of number may pay out at a ratio of 5 to 1; a winning wager for the combination of numbers 1 to 18 or the combination of numbers from 19 to 36 may pay out at a ratio of 1 to 1; a winning wager on a column of numbers may pay out at a ratio of 2 to 1; a winning wager on a block of twelve consecutive numbers (first twelve, second twelve or last twelve) may pay out at a ratio of 2 to 1, and a winning wager on an odd number; an even number, a red number or a black number may pay out even money. Other wager combinations and associated payout ratios may also be used.

The prior art American roulette wheel arrangement is shown in FIG. 2. As shown, the prior art American wheel includes both zero (0) and double zero (00) house numbers arranged opposite each other and thirty six numbers from 1 to 36 arranged around the perimeter of the wheel for a total of thirty eight pockets. The house numbers (0, 00) are typically green in color. The numbers 1, 3, 5, 7, 9, 12, 14, 16, 18, 19, 21, 23, 25, 27, 30, 32, 34 and 36 are red, and the numbers 2, 4, 6, 8, 10, 11, 13, 15, 17, 20, 22, 24, 26, 28, 29, 31, 33 and 35 are black.

The numbers from 1 to 36 are arranged at standardized positions on the prior art American wheel as shown. Black and red numbers alternate and directly across the wheel from each odd number is the next highest even number (for example the number 10 is directly across the wheel from the number 9).

FIG. 3 shows the prior art European roulette wheel arrangement. As shown, the European roulette wheel arrangement includes only one house number, the single zero (0) and thirty six numbers, for a total of thirty seven pockets. This results in a significantly lower house advantage for the European wheel (approximately 2.70%) as compared to the American wheel (approximately 5.26%). The individual numbers from 1 to 36 in the prior art European roulette wheel have the same colors as they have in the prior art American roulette wheel, and the numbers are also arranged at standardized positions; however the arrangement of numbers around the wheel differs substantially in the European roulette wheel as compared to the American wheel.

The arrangement of numbers and colors on the prior art roulette game surface shown in FIG. 1 (and used with both the prior art American roulette wheel arrangement shown in FIG. 2 and the prior art European roulette wheel arrangement shown in FIG. 3) is not optimized or balanced with respect to the entire game surface, the individual columns and the individual dozen wagering groups (1-12, 13-24 and 25-36) as set forth below. In particular, the distribution of red, black, odd and even numbers on the prior art roulette game surface is unbalanced and as a result experienced players may combine bets on red, black, even and odd numbers, columns and dozen groups to increase the player's chances of winning a bet. In addition, an inexperienced player may lack the knowledge to take advantage of these relationships, resulting in a greater advantage for the casino or house.

As shown in FIG. 1, the prior art roulette game surface arrangement has ten red odd numbers (1, 3, 5, 7, 9, 19, 21, 23, 25 and 27), but only eight red even numbers (12, 14, 16, 18, 30, 32, 34 and 36). Additionally, the prior art arrangement has ten black even numbers (2, 4, 6, 8, 10, 20, 22, 24, 26, 28), but only eight black odd numbers (11, 13, 15, 17, 29, 31, 33 and 35). This imbalance in the distribution of red, black, odd and even numbers throws off the balance of the individual columns and dozen wagering areas.

In the prior art roulette game surface arrangement, the first column consists of six red numbers (1, 7, 16, 19, 25 and 34). Of these six red numbers, however, four numbers are odd (1, 7, 19 and 25) and only two numbers are even (16 and 34). Moreover, two of the odd red numbers (1 and 7) are in the first dozen wagering area, whereas the second and third dozen wagering areas each have one red odd and one red even number in the first column (16, 19 and 25, 34, respectively) Thus, the first column includes one even red number (16) in the second dozen wagering area, one even red number (34) in the third dozen wagering area, but no even red numbers in the first dozen wagering area.

The first column in the prior art roulette game surface further includes six black numbers (4, 10, 13, 22, 28, and 31). Of these six black numbers, however, four numbers are even (4, 10, 22, and 28) and only two numbers are odd (13 and 31). Moreover, two of the black even numbers (4 and 10) are in the first dozen wagering area, whereas the second and third dozen wagering areas each have one black odd and one black even number in the first column (13, 22 and 28, 31, respectively). Thus the first column includes one odd black number (13) in the second dozen wagering area, one odd black number (31) in the third dozen wagering area, but no odd black numbers in the first dozen wagering area.

In the prior art roulette game surface arrangement, the second column consists of four red numbers (5, 14, 23 and 32). Of these four red numbers, two are in the second dozen wagering area (14 and 23) while the first and third dozen wagering areas have only one red number each (5 and 32, respectively). Additionally, the first dozen wagering area includes no even red numbers in the second column and the third dozen wagering area includes no odd red numbers in the second column.

The second column in the prior art roulette game surface further includes eight black numbers (2, 8, 11, 17, 20, 26, 29 and 35). Of these eight black numbers, three (2, 8 and 11) are in the first dozen wagering area and three (26, 29 and 35) are in the third dozen wagering area, while the second dozen wagering area only includes two black numbers (17 and 20). Moreover, the first dozen wagering area includes two even black numbers (2 and 8) and only one odd black number (11) in the second column. The third dozen wagering area includes two black odd numbers (29 and 35) and only one black even number (26) in the second column. The second wagering area includes one black odd number (17) and one black even number (20) in the second column.

In the prior art roulette game surface arrangement, the third column consists of eight red numbers (3, 9, 12, 18, 21, 27, 30 and 36). Of these eight red numbers, three (3, 9 and 12) are in the first dozen wagering area and three (27, 30 and 36) are in the third dozen wagering area, while the second dozen wagering area includes only two red numbers (18 and 21). Moreover, the first dozen wagering area includes two odd red numbers (3 and 9) and only one even red number (12) in the second column. The third dozen wagering area includes two red even numbers (30 and 36) and only one red odd number (27) in the second column. The second wagering area includes one red even number (18) and one red odd number (21) in the second column.

The third column in the prior art roulette wheel arrangement further includes four black numbers. Of these four black numbers, two are in the second dozen wagering area (15 and 24) while the first and third dozen wagering areas have only one black number each (6 and 33, respectively) Additionally, the first dozen wagering area includes no odd black numbers in the third column and the third dozen wagering area includes no even black numbers in the third column.

Turning to the dozen wagering areas or groups on the prior art roulette game surface, the first dozen wagering area (1-12) includes six red numbers (1, 3, 5, 7, 9 and 12) and six black numbers (2, 4, 6, 8, 10 and 11). However, of the six red numbers, five are odd (1, 3, 5, 7 and 9) and only one is even (12). Moreover, of the six black numbers in the first dozen wagering area, five are even (2, 4, 6, 8 and 10) and only one is odd (11). Accordingly, the first dozen wagering area of the prior art roulette game surface is unbalanced with respect to the distribution of red, black, odd and even numbers.

The second dozen wagering area (13-24) of the prior art roulette game surface arrangement includes six red numbers (14, 16, 18, 19, 21 and 23), three of which are even (14, 16 and 18) and the remaining three (19, 21 and 23) of which are odd. This represents a balanced arrangement. Moreover, the second dozen wagering area includes six black numbers (13, 15, 17, 20, 22 and 24), three of which are odd (13, 15 and 17) and the remaining three of which are even (20, 22 and 24). This represents a balanced arrangement.

The third dozen wagering area (25-36) of the art roulette game surface arrangement includes six red numbers (25, 27, 30, 32, 34 and 36) and six black numbers (26, 29, 31, 33 and 35). However, of the six red numbers, four are even (30, 32, 34 and 36) and only two are odd (25 and 27). Moreover, of the six black numbers in the third dozen wagering area, four are odd (29, 31, 33 and 35) and only two are even (26 and 28). Accordingly, the third dozen wagering area of the prior art roulette game surface is also unbalanced with respect to the distribution of red, black, odd and even numbers.

In addition to the uneven distribution of red, black, odd and even numbers on the prior art roulette game surface, it has been observed that the arrangement of corresponding numbers on the prior art roulette wheels (both American and European) has a relationship to various arrangements of colors, odds, evens, columns and groups on the roulette game surface as set forth below.

The relationships among adjacent numbers on the prior art roulette wheels and their corresponding positions, groupings and characteristics on the prior art roulette game surface may allow experienced players to combine bets on red, black, even and odd numbers, columns and dozen groups to increase the player's chances of winning. For example in the prior art arrangements, players may "flower" the wheel by placing bets corresponding to a group of numbers positioned on the roulette wheel adjacent or in close proximity to one another. By utilizing progressive betting techniques and taking advantage of the relationship between the positions of the numbers on the roulette wheel and the various betting schemes (red, black, odd, even, column, dozen group) a professional or experienced player may increase his or her odds of winning.

As shown in FIG. 2 and FIG. 1, the following relationships exist between the arrangement of numbers on the prior art American roulette wheel and the corresponding prior art game surface. Moving clockwise from the double zero (00) house number, the numbers 10 and 25 are adjacent to one another on the wheel and are in the same column, namely the first column, on the game surface. Numbers 25 and 29 are adjacent to one another on the wheel, are both odd numbers, are diagonally adjacent to one another on the game surface and are in the same group, namely the third dozen wagering area, on the game surface. Numbers 12 and 8 are adjacent to one another on the wheel, are both even, are diagonally adjacent to one another on the game surface, and are both in the same group, namely the first dozen wagering area, on the game surface. Numbers 19 and 31 are adjacent to one another on the wheel, are both odd and are in the same column, namely the first column, on the game surface. Numbers 18 and 6 are adjacent to one another on the wheel, are both even and are in the same column, namely the third column, on the game surface.

Moreover, the three numbers 18, 6 and 21 are arranged consecutively on the wheel, and all are in the same column, namely the third column, on the game surface. The numbers 18 and 21 are also in the same group, the second dozen wagering area, and adjacent to one another on the game surface (18 is positioned directly above 21).

The four numbers 18, 6, 21 and 33 are arranged consecutively on the wheel, and all are in the same column, namely the third column, on the game surface. The numbers 18 and 21 are adjacent one another on the game surface, and 18 and 6 are both even numbers and adjacent to one another on the wheel. The numbers 21 and 33 are both odd numbers and adjacent on the wheel. Two of the numbers from this grouping (18 and 21) are in the second dozen wagering area, wherein 6 is in the first dozen wagering area and 33 is in the third wagering area. Accordingly, this grouping of numbers is unbalanced.

The numbers 16 and 4 are adjacent to one another on the wheel, are both even and are in the same column, namely the first column, on the game surface. The numbers 23 and 35 are adjacent to one another on the wheel, are both odd and are in the same column, namely the second column, on the game surface.

The three numbers 23, 35 and 14 are arranged consecutively on the wheel, and all three are in the same column, namely the second column, on the game surface. Two of the numbers from this group (23, 35) are odd numbers.

The four numbers 23, 35, 14 and 2 are arranged consecutively on the wheel and all four are in the same column, namely the second column of the game surface. Two of the numbers from this grouping (14 and 23) are in the second dozen wagering area, wherein 2 is in the first dozen wagering area and 35 is in the third wagering area. Accordingly, this grouping of numbers is unbalanced.

The groups of four consecutive numbers on the wheel consisting of first group 18, 6, 21 and 33, which are all in the third column on the game surface, and second group 23, 35, 14 and 2, which are all in the second column on the game surface, are only separated on the prior art wheel by a single pair of adjacent numbers, 16 and 4. This grouping of ten consecutive numbers on the prior art American roulette wheel is not balanced by any corresponding grouping on the other side of the wheel.

Moving clockwise from the single zero (0) house number of the prior art American roulette wheel layout shown in FIG. 2, the numbers 26 and 30 are adjacent to one another on the wheel, are both even, are both in the third dozen wagering area on the game surface and are diagonally adjacent on the game surface. The numbers 11 and 7 are adjacent to one another on the wheel, are both odd and are both in the first dozen wagering area on the game surface. The numbers 20 and 32 are adjacent to one another on the wheel, are both even and are both in the same column, namely column 2, on the game surface.

The three numbers 20, 32 and 17 are arranged consecutively on the wheel, and all three are in the same column, namely the second column, on the game surface. Two of the numbers from this group (20 and 32) are even numbers. The numbers 20 and 17 are adjacent to each other on the game surface and both in the second dozen wagering area. The four numbers 20, 32, 17 and 5 are arranged consecutively on the wheel, and all four are in the same column, namely the second column, on the game surface. The numbers 20 and 32 are both even. Two numbers from this grouping (17 and 20) are in the second dozen wagering area, one number (5) is in the first dozen wagering area and one number (32) is in the third dozen wagering area. Accordingly, this grouping of numbers is unbalanced.

The numbers 22 and 34 are adjacent to one another on the wheel, both are even and both are in the same column, namely the first column, on the game surface. The numbers 15 and 3 are adjacent to one another on the wheel, both are odd and both are in the same column, namely the third column, on the game surface.

The three numbers 15, 3 and 24 are arranged consecutively on the wheel and are all in the same column, namely the third column, on the game surface. Two of the numbers (15 and 3) are odd numbers. The four numbers 15, 3, 24 and 36 are arranged consecutively on the wheel and all four numbers are in the same column, namely the third column, on the game surface. Two numbers from this grouping (15 and 24) are in the second dozen wagering area, one number (3) is in the first dozen wagering area and one number (36) is in the third dozen wagering area. Accordingly, this grouping of numbers is unbalanced.

The groups of four consecutive numbers on the wheel consisting of first group 20, 32, 17 and 5, which are all in the second column on the game surface, and second group 15, 3, 24 and 36, which are all in the third column on the game surface, are only separated on the wheel by a single pair of adjacent numbers, 22 and 34. This grouping of ten consecutive numbers on the prior art American roulette wheel is not balanced by any corresponding grouping on the other side of the wheel. In particular, there are two numbers (13 and 1) between this grouping often numbers (20, 32, 17, 5, 22, 43, 15, 3, 24, and 36) and the house number 00, while the grouping of ten numbers 18, 6, 21, 33, 16, 4, 23, 35, 14 and 2 on the other half of the wheel is adjacent to the house number 0. Thus the groupings are not balanced or symmetric with respect to their arrangement on the wheel.

Additionally, the numbers 13 and 1 are adjacent to one another on the wheel, are both odd and are in the same column, namely the first column, on the game surface.

As shown in FIG. 3 and FIG. 1, the following relationships exist between the arrangement of numbers on the prior art European roulette wheel and the corresponding prior art game surface. Moving clockwise from the house number 0, the numbers 15 and 19 are adjacent to one another on the wheel, are both odd and are both in the second dozen wagering area on the gaming surface. The numbers 4 and 19 are adjacent to each other on the wheel and are in the same column, namely the first column on the game surface. The numbers 6 and 27 are adjacent to one another on the wheel and are in the same column, namely the third column, on the game surface. The numbers 8 and 23 are adjacent to one another on the wheel and are in the same column, namely the second column, on the game surface.

Additionally, on the prior art European roulette wheel, the numbers 10 and 5 are adjacent to one another and both numbers are in the first dozen wagering area on the game surface. The numbers 16 and 24 are adjacent to one another on the wheel, are both even and are both in the second dozen wagering area on the game surface. The numbers 14 and 20 are adjacent to one another on the wheel, are both even, are both in the second column and are both in the second dozen wagering area on the game surface.

The numbers 22 and 18 are adjacent to one another on the wheel, are both even and are both in the second dozen wagering area on the game surface. The numbers 7 and 28 are adjacent to one anther on the wheel and are both in the same column, namely the first column, on the game surface. The numbers 26 and 32 are separated only by the house number 0, are both even, are both in the second column and in the third dozen wagering area of the game surface.

Accordingly there exists a need for improved roulette board game surface and wheel arrangements having a balanced layout wherein red and black and even and odd numbers are evenly distributed. Moreover, the need exists for an improved roulette game surface and wheel arrangement wherein relationships between adjacent pairs or groups of numbers on the wheel and the arrangement and characteristics of numbers on the game surface is eliminated.

The game of roulette has always been restricted to a game having about 36 numbers on the wheel and one or two house numbers designated as 0 or 00 or both. However, there is nothing magical about having 36 numbers on the wheel. The present invention is directed to a super-roulette same having more than 36 numbers having a balanced layer on the board game surface and wheel arrangement.

SUMMARY OF THE INVENTION

The present invention includes a roulette wheel apparatus that contains more than 36 numbers, excluding the house numbers, as defined herein. Indicia on a game surface are associated with the roulette wheel. The indicia on the game surface include all of the whole numbers on the roulette wheel arranged in numerical order, wherein one half of the whole numbers are associated with a first color and the remaining half are associated with a second color. The whole numbers are arranged on the game surface in columns and rows in ascending order beginning from a top left corner and proceeding from left to right across the rows. The whole numbers are arranged on the game surface such that the amount of whole numbers in each column is the same, and the amount of whole numbers in each row is the same. However, the number of rows may or may not be equal to the number of columns, and the number of whole numbers in the columns may or may not be equal to the number of whole numbers in the rows. The whole numbers in the game surface may be further grouped. But each grouping must contain the same number of whole numbers. But, the number of groups may or may not equal the number of rows or the number of columns. Further, the mount of whole numbers in each group may be the same or different from either the amount of whole numbers in each row or the amount of whole numbers ion each column.

If the roulette wheel contains house numbers, the game surface indicia may or may not contain the house numbers. If house numbers are included in the game surface, they are arranged in an area separate from the indicia of whole numbers.

Excluding the house numbers, the number of whole numbers on the roulette wheel cannot be a prime number. In addition, the number of whole numbers on the roulette wheel is a number, which is an even number. Further, it is a number, which is evenly divisible by the number of columns and rows described hereinabove on the game surface. In an embodiment, the whole numbers on the game surface are divisible by 3 or 4.

Examples of amount of whole number on the roulette wheel, excluding house numbers are 42, 48, 54, 60, 72 and the like.

However, no matter how large the amount of whole numbers there are on the roulette wheel, no two adjacent numbers on the roulette wheel are associated with the same color, are disposed in the same group on the game surface, are disposed in the same column on the game surface, or are disposed adjacent one another on the game surface.

For example, when the roulette wheel contains sixty whole numbers, excluding the house numbers, the game surface may be divided into three groups of twenty numbers, 1-20, 21-40 and 41-60. In addition, there may be 5 columns, consisting of 12 rows, each row containing 5 whole numbers in numerical order, 1-5, 6-10, 11-15, 16-20, 21-25, 26-30, 31-35, 36-40, 41-45, 46-50, 51-55, and 56-60.

In the embodiment, no two adjacent numbers on the roulette wheel are associated with the same color or disposed in the same group on the game surface, are disposed in the same column on the game surface or are disposed adjacent to one another on the game surface. The pattern may be the same or different in each half of the roulette wheel.

A method for arranging indicia on a game surface and on an associated roulette wheel for a roulette game according to an embodiment of the invention includes arranging indicia indicating one or more house numbers on the game surface. In the example of a roulette wheel having 60 numbers, excluding house numbers, indicia indicating sixty whole numbers comprising the numbers 1 through 60 are arranged on the game surface, wherein one half of the whole numbers are associated with a first color and a remaining half of the whole numbers are associated with a second color. The whole numbers are arranged on the game surface in a matrix of five columns and twelve rows in ascending order beginning from a top left corner and proceeding from left to right across the rows.

The whole numbers are arranged in three groups of twenty numbers each, a first group comprising the numbers 1 through 20, a second group comprising the numbers 21 through 40 and a third group comprising the numbers 41 through 60. Each of said first, second and third groups comprises five even numbers associated with the first color, five odd numbers associated with first color, five even numbers associated with the second color and five odd numbers associated with the second color.

Indicia indicating the one or more house numbers are arranged on the roulette wheel. Although the house number(s) may be any symbol or any number except 1-60, typically, the house numbers are 0 or 00 or combination thereof. They are typically arranged symmetrically on the roulette wheel. For example if 6 house numbers are present on the roulette wheel, obviously there are 10 numbers on the roulette wheel separating each house number; if 5 house numbers are on the wheel, there are 12 numbers separating each house number; if there are 4 house numbers on the wheel, there are 15 numbers separating each of them; if there are 3 house numbers present on the wheel, there are 20 numbers separating each of them; if there are two house numbers on the roulette wheel, there are 30 numbers separating each of them. Finally, if there is one house number, then there are 61 numbers on the wheel, ranging from 0 to 60 (there are 60 number in separating the one house number.) Although normally if one house number is present, one cannot have a symmetrical relationship, for purposes of this application, when discussing the arrangement of house numbers, it is to be understood when there are the same amount of numbers separating each house number or when there are 60 numbers separating each house number, it is to be designated as the house number are symmetrically arranged.

The roulette wheel is divided into thirty numbers, 1-30 and 31-60. Indicia indicating each of the sixty whole numbers are arranged on the roulette wheel in a circumferential manner by selecting a first whole number associated with the first color or the second color and disposed in one of the five columns and one of the three groups and indicating the first whole number on the roulette wheel.

A second whole number associated with another of the first color or the second color and disposed in another of the five columns and another of the three groups is selected and indicated on the roulette wheel adjacent to the first number; a third whole number is selected which is associated with the first color or the second color and disposed in one of the five columns not previously selected and in another of the three groups and indicating the third whole number on the roulette wheel adjacent to the second where number on the roulette wheel not previously selected. A fourth whole number is selected which is associated with the first color or the second color and disposed in another of the five columns not previously selected but is disposed in the first group previously selected and indicating the fourth whole number on the roulette wheel adjacent to the third whole number on the roulette wheel; a fifth whole number is selected which is associated with the first color or the second color and disposed in one of the five columns not previously selected and in the second of the three groups previously selected, and indicating the fifth whole number on the roulette wheel adjacent to the fourth whole number on the roulette wheel.

This pattern is repeated on the roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface. The pattern may be the same or different in each half of the roulette wheel.

Further, in an embodiment of the present invention, at least about 67% of the numbers are arranged on the roulette wheel such that each number, when traversing the roulette wheel clockwise, beginning at a first pocket location, of a first half of the roulette wheel and a corresponding positioned number when traversing the roulette wheel counterclockwise beginning at the first pocket location of the second half of the roulette wheel will add up to 61 for each pair of like positioned numbers. It is noted that within the remaining numbers (the other about ⅓ of the numbers), there are pairs of numbers that also add up to 61. Moreover, in a particular embodiment, e.g., when the roulette wheel contains an even number of house numbers or 0 house numbers, the numbers are arranged on the roulette wheel such that, each number when traversing the roulette wheel clockwise beginning at a first pocket location of a first half of the roulette wheel and a corresponding positioned number when traversing the roulette wheel counter-clockwise beginning at the first pocket location of the second half of the roulette wheel will add up 61 to for each pair of like positioned numbers. If the roulette wheel has an even number of house numbers, e.g., two, four, etc., it is preferred that the numbers on the roulette wheel are so arranged such that each number, when traversing the roulette wheel clockwise beginning at a first pocket location of the first half of the roulette wheel and a corresponding positioned number when traversing the roulette wheel counter-clockwise beginning at the first pocket location of the second half of the roulette wheel will add up to 61 for each pair of like positioned numbers. When there are an odd number of house numbers, about two-thirds and more preferably at least about 67% of the numbers, excluding house numbers, beginning at first pocket location of the first half of the roulette wheel and a corresponding positioned number when traversing the roulette wheel counter-clockwise beginning at the first pocket location of the second half of the roulette wheel add up to 61 for each pair of like positioned numbers. For the remaining about one-third of the numbers, it is to be noted that one-half of those remaining are in one half of roulette wheel and the remaining one-half of those remaining are in the other half of the roulette wheel. The total amount of numbers that remains which do not fit the pattern on the top half of the roulette wheel equal the amount of numbers on the bottom wheel which do not fit the pattern. However, the remaining numbers may be arranged to form another pattern. For example, the remaining numbers may be arranged so that each number, when traversing roulette wheel clockwise beginning at a pocket location of the remaining numbers of a first half of the roulette wheel and a corresponding positioned number of the remaining about one-half of those remaining on the other half of the roulette wheel when traversing the roulette wheel counter-clockwise beginning at the corresponding positioned number also add to 61 for each pair of the positioned numbers.

Moreover, each of the corresponding positioned number pair on the wheel that adds to 61 is of the same color.

Roulette game apparatuses comprising game surfaces and roulette wheels conforming to the method are also disclosed.

An advantage of a method for arranging indicia on a roulette game surface and on an associated roulette wheel and of roulette game apparatuses according to embodiments of the invention is that the relationships between adjacent numbers on the prior art roulette wheel and their corresponding characteristics and positions on the prior art game surface are eliminated or minimized. Accordingly, players using a game surface and roulette wheel according to embodiments of the invention are unable to take advantage of the relationship between the positions of the numbers on the prior art roulette wheel and the betting combinations available on the prior art game surface to increase their odds of winning.

The game surface and wheel arrangements according to embodiments of the invention achieve fairness, balance and consistency for the player and casino by providing a perfect balance of red, black, odd and even numbers on the game surface and a roulette wheel layout which is matched to a corresponding game surface or board to eliminate relationships between groups of numbers on the wheel and betting arrangements on the game surface.

A further advantage of a super roulette wheel arrangement according to a method and apparatus of the invention is that an arrangement may be provided that is adaptable for both American and European use with a common game surface have substantially the same arrangement of numbers. This feature may increase player interest, as players familiar with one of the American or European roulette wheel arrangement will also be easily familiarized with the other style wheel.

Moreover, it is understood that the concept of the super roulette wheel of the invention herein may be adapted for use in other like gaming devices, e.g., a pin-wheel game.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements.

DETAILED DESCRIPTION OF TEE PREFERRED EMBODIMENTS

Figure 1:
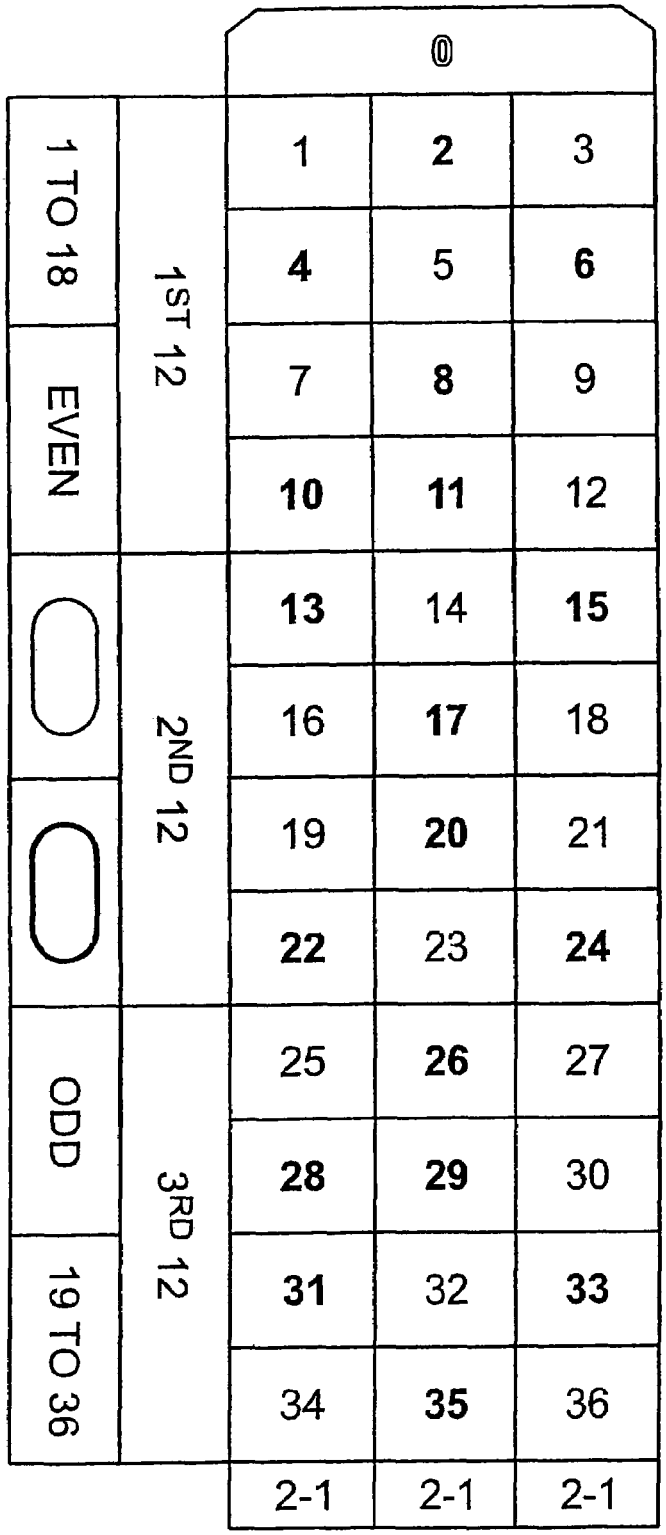
FIG. 1 (Prior Art)
FIG. 1 shows a prior art game surface for a roulette game.

In the drawings, numbers and symbols in regular typeface indicate a first color, for example red. Numbers and symbols in bold typeface indicate a second color, for example black. Numbers in an outline type format indicate a third color, for example green.

Applicant's U.S. patent application Ser. No. 11/593,322 is directed to a novel roulette wheel and game board surface arrangement that includes thirty-six individual number wagering areas, each corresponding to a whole number from 1 to 36 are arranged on the game surface. The thirty six individual number wagering areas are arranged in ascending order from left to right in a matrix of three columns and twelve rows. In the accompanying game surface, the thirty six individual whole numbers are evenly distributed in a perfectly balanced manner wherein nine odd numbers are associated with a first color (for example red), nine odd numbers are associated with a second color (for example black), nine even numbers are associated with a first color (for example red) and nine even numbers are associated with a second color (for example black). Moreover, each of the three columns in a game surface comprises six numbers associated with the first color and six numbers associated with the second color. Each of the columns in a game surface comprises six odd numbers and six even numbers. Each of the columns in a game surface comprises three even numbers associated with the first color, three even numbers associated with the second color, three odd numbers associated with the first color and three odd numbers associated with the second color. Additionally, each of the three groups of twelve numbers corresponding to the first, second and third dozen wagering areas in a game surface comprises three even numbers associated with the first color, three even numbers associated with the second color, three odd numbers associated with the first color and three odd numbers associated with the second color. Moreover, Applicant's U.S. patent application Ser. No. 11/593,322 further describes the pockets and corresponding numbers on the roulette wheel as being arranged such that no two adjacent numbers on the roulette wheel are associated with a same color, are disposed in a same group on an associated game surface, are disposed in a same column on an associated game surface, are disposed in a same row on an associated game surface, or are disposed adjacent one another on an associated game surface.

An embodiment of the present application refers to a roulette wheel apparatus containing more than 36 whole numbers thereon. In an embodiment of the present invention, the roulette game apparatus comprises:

a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to one half of the whole numbers on the roulette wheel;

(vii) a high number wagering area corresponding to a whole number from the remainder of the whole numbers on the roulette wheel;

(viii) a first grouping of the numbers in a first other wagering area corresponding to a whole number from 1 to the number of groups of the whole numbers on the roulette wheel, wherein the number of whole numbers is evenly divisible in the number of groupings, said whole numbers being evenly divided into three or four groupings;

(ix) a second grouping of the numbers in a second other wagering area corresponding to a whole number containing the second grouping of whole numbers;

(x) additional grouping of the numbers in an additional other wagering area corresponding to a whole number containing additional grouping of numbers but containing the amount of numbers as the first grouping and the second grouping, the number of additional groupings being 1 or 2, depending on whether the number of groupings is three or four, such that if the number of groupings is 3, then there is one additional other wagering area containing the final third of the numbers and if the number of groupings is four, two other wagering areas, one containing the whole numbers ranging from the number which is one greater than the number which is half the number of whole numbers to a number which is ¾ of the whole numbers, and the other waging area being the remaining fourth of the whole numbers; and (xi) a number of individual number wagering areas equal to the amount of whole numbers on the roulette wheel, said number wagering areas arranged in ascending order from left to right in a matrix of columns and rows, wherein the number of whole numbers is evenly divisible by both the number of rows and columns and wherein one half of the number wagering area is associated with said first color, and the remaining number of wagering areas corresponding to numbers is associated with said second color; and b) a roulette wheel comprising a plurality of pockets disposed in a circumferential manner, each of said pockets corresponding to a house number or to a whole number from 1 to a number greater than 36, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface and such that the roulette wheel contains an even number of whole numbers, excluding house numbers, and such that the number of whole numbers on the wheel is a number in which goes evenly into the number of rows and columns on the game surface, and the number of whole numbers on the roulette wheel is divisible by three or four, and wherein the number of whole numbers is an even number. It is preferred that the there are only three other waging areas, the first corresponding from 1 to one-third of the numbers on the roulette wheel, a second other wagering area containing the second third of the numbers on the roulette wheel, and a third other wagering corresponding to the final third of the whole numbers on the roulette wheel.

For example, in an embodiment of the present invention wherein the roulette wheel contains 60 whole numbers and where the roulette game apparatus has 60 individual number wagering areas, the roulette game apparatus comprises:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 30;

(vii) a high number wagering area corresponding to a whole number from 31 to 60;

(viii) a first other wagering area corresponding to a whole number from 1 to 20;

(ix) a second other wagering area corresponding to a whole number from 21 to 40;

(x) a third other wagering area corresponding to a whole number from 41 to 60; and (xi) sixty individual number wagering areas, each corresponding to a whole number from 1 to 60, said sixty individual number wagering areas arranged in ascending order from left to right in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to thirty of the sixty numbers associated with said first color, and individual number wagering areas corresponding to the remaining numbers are associated with said second color; and b) a roulette wheel comprising a plurality of pockets disposed in a circumferential manner, each of said pockets corresponding to a house number or to a whole number from 1 to 60, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface.

The roulette game apparatus described herein additionally comprises one to four house numbers on the roulette wheel evenly spaced apart, as defined herein.

Figure 4:
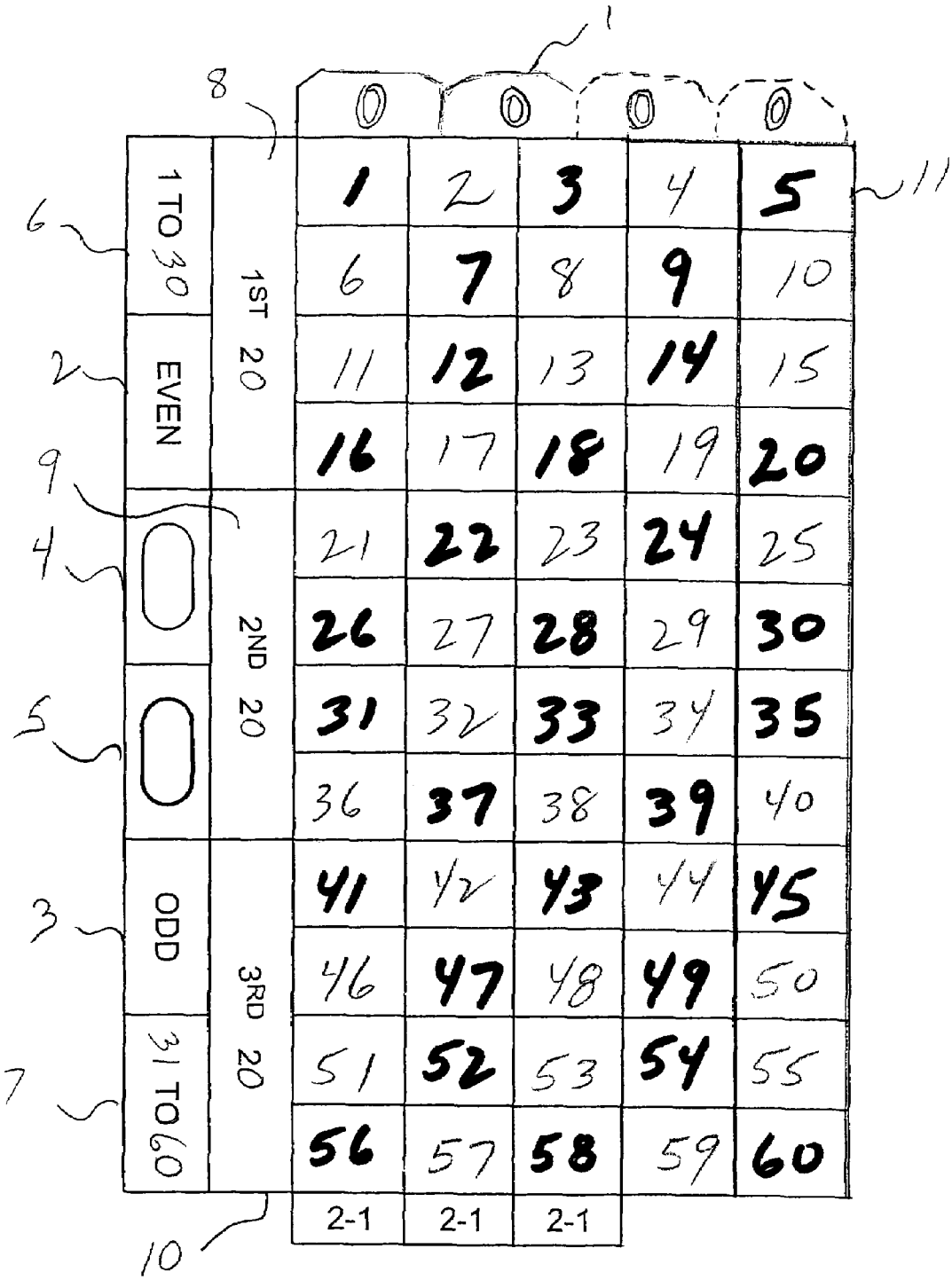
FIG. 4 shows a game surface according to an embodiment of the invention.
Figure 5:
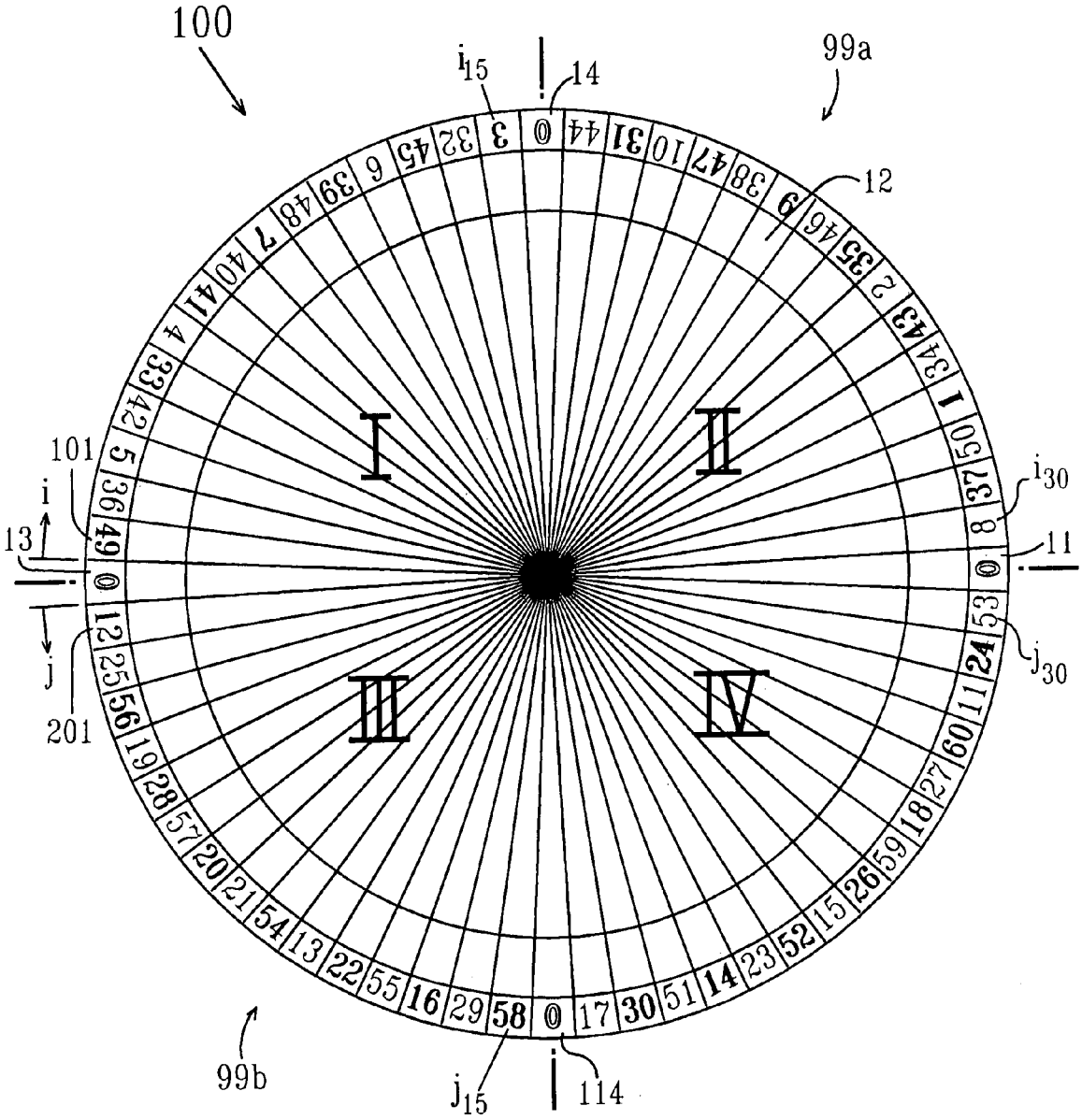
FIG. 5 shows an example roulette wheel arrangement for use with the game surface shown in FIG. 4, according to an embodiment of the invention.
Figure 6:
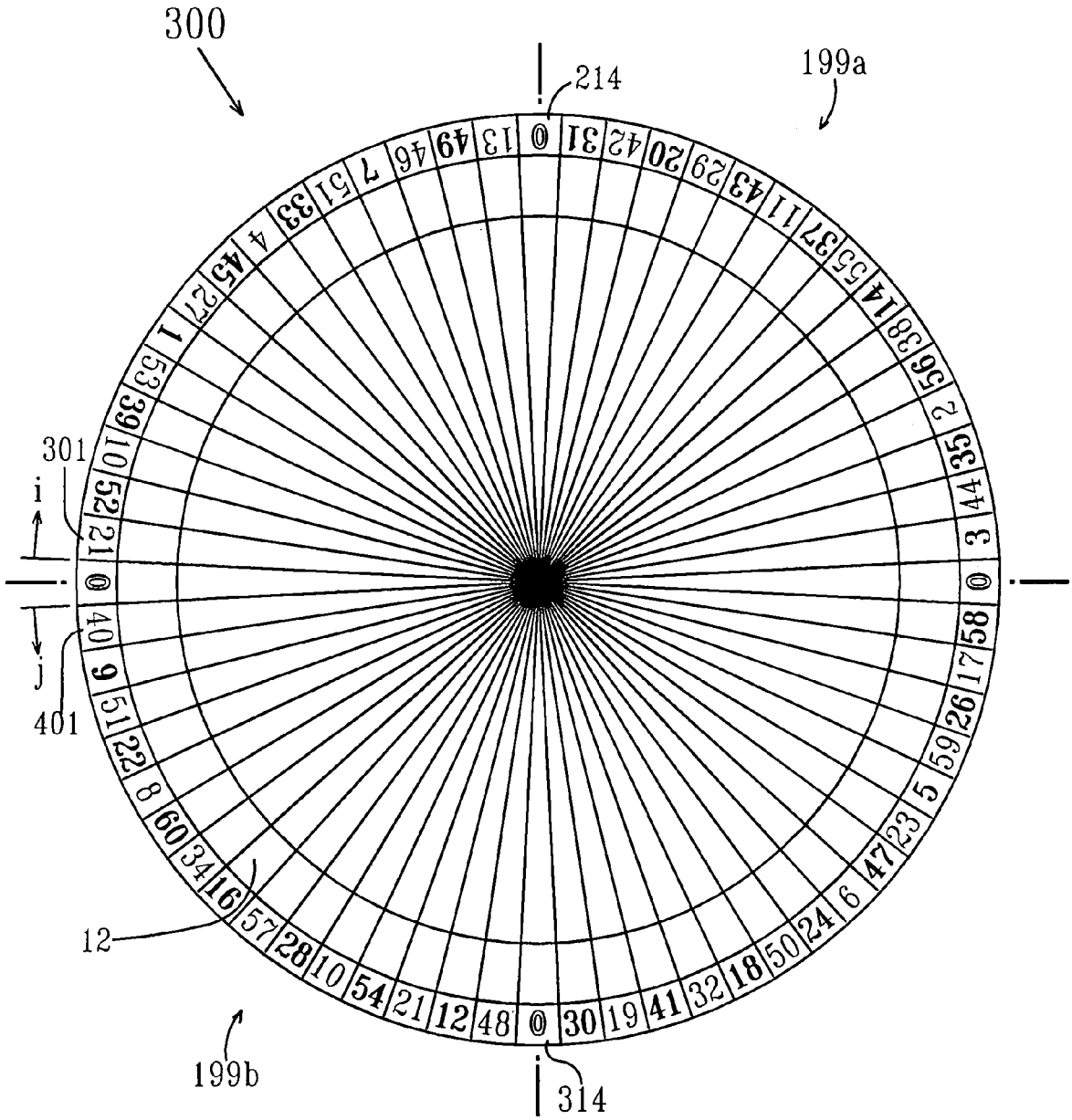
FIG. 6 shows another example roulette wheel arrangement for use with the game surface shown in FIG. 4, according to an embodiment of the invention; and, FIG. 7 shows another example roulette wheel arrangement for use with the game surface shown in FIG. 4, according to a further embodiment of the invention.
Figure 7:
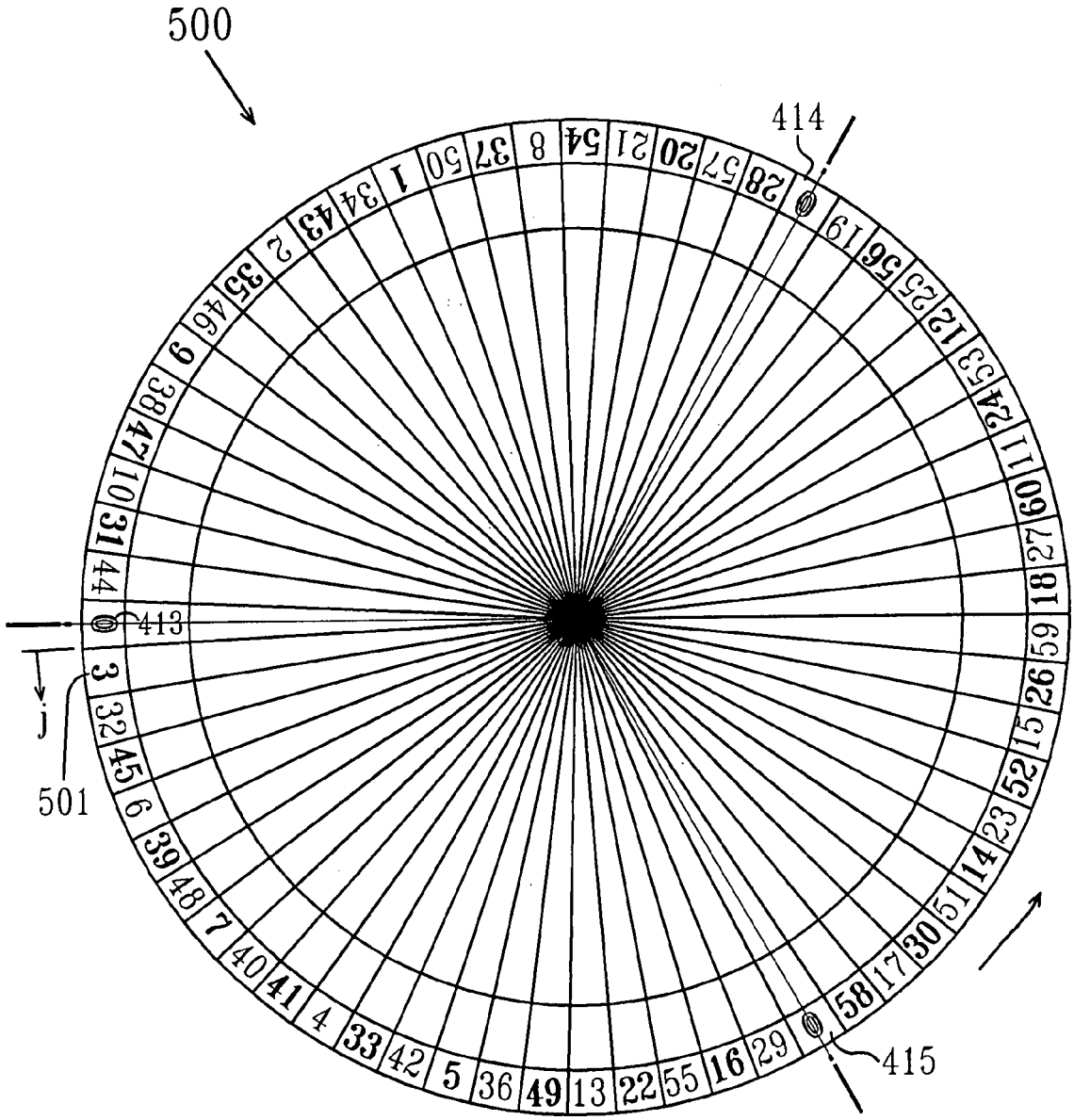

FIG. 4 illustrates a game surface according to embodiments of the present invention that is directed to a novel roulette wheel and game board surface arrangement that includes a number of individual number waging areas, when the number is greater than 36, e.g., 60, each number waging area corresponding to a whole number from 1 to a number greater than 36, e.g. 60, that are arranged on the game surface. FIGS. 5, 6, and 7 show roulette wheel arrangements according to embodiments of the present invention. In particular, FIGS. 5, 6 and 7 show roulette wheel arrangements suitable for use with the game surface shown in FIG. 4.

FIG. 5 illustrates a roulette wheel arrangements according to embodiments of the invention wherein the wheel has four house numbers, e.g., two 0s and two 00s or 4 0s or 4 00s or combination thereof disposed diametrically opposite one another. In other embodiments, there may be three or less house numbers.

As illustrated in FIG. 4, a game surface according to an embodiment of the invention includes up to four (4) house number wagering areas 1 for placing a wager on a house number. The game surfaces also include an even number wagering area 2 for wagering on the even numbers (2, 4, 6, 8, 10, 12, 14, 16, 18, 20, 22, 24, 26, 28, 30, 32, 34, 36, 38, 40, 42, 44, 46, 48, 50, 52, 54, 56, 58 and 60) and an odd number wagering area 3 for wagering on the odd numbers (1, 3, 5, 7, 9, 11, 13, 15, 17, 19, 21, 23, 25, 27, 29, 31, 33, 35, 37, 39, 41, 43, 45, 47, 49, 51, 53, 55, 57, 59). The game surface further includes a first color wagering area 4 for wagering on numbers associated with a first color, for example red, and a second color wagering area 5 for wagering on numbers associated with a second color, for example black.

A game surface according to an embodiment of the invention further includes a low number wagering area 6 for wagering on the numbers from 1 to 30 and a high number wagering area 7 for wagering on the numbers from 31 to 60. A first other wagering area 8 for wagering on the numbers from 1 to 20, a second other wagering area 9 for wagering on the numbers from form 21 to 40, and a third other wagering area 10 for wagering on the numbers from 41 to 60 are also disposed on the game surface.

Sixty individual number wagering areas 11, each corresponding to a whole number from 1 to 60 are arranged on the game surface. As shown, the sixty individual number wagering areas are arranged in ascending order from left to right in a matrix of five columns and twelve rows.

As shown in FIG. 4, in a game surface according to an embodiment of the invention, the sixty individual whole numbers are evenly distributed in a perfectly balanced manner wherein fifteen odd numbers are associated with a first color (for example red), fifteen odd numbers are associated with a second color (for example black), fifteen even numbers are associated with a first color (for example red) and fifteen even numbers are associated with a second color (for example black).

Moreover, each of the five columns in a game surface according to an embodiment of the invention comprises six numbers associated with the first color and six numbers associated with the second color. Each of the columns in a game surface according to an embodiment of the invention comprises six odd numbers and six even numbers. Each of the columns in a game surface according to an embodiment of the invention comprises three even numbers associated with the first color, three even numbers associated with the second color, three odd numbers associated with the first color and three odd numbers associated with the second color.

Additionally, each of the three groups of twenty numbers corresponding to the first, second and third other wagering areas in a game surface according to an embodiment of the invention comprises five even numbers associated with the first color, five even numbers associated with the second color, five odd numbers associated with the first color and five odd numbers associated with the second color.

For example, as shown in the game surface illustrated in FIG. 4, individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 are associated with a first color (e.g., black), and individual number wagering areas corresponding to numbers 2, 4, 6, 8, 10,

11, 13, 15, 17, 19, 21, 23, 25, 27, 29, 32, 34, 36, 38, 40, 42, 44, 46, 48, 50, 51, 53, 55, 57 and 59 are associated with a second color (e.g., red).

Figure 4A:
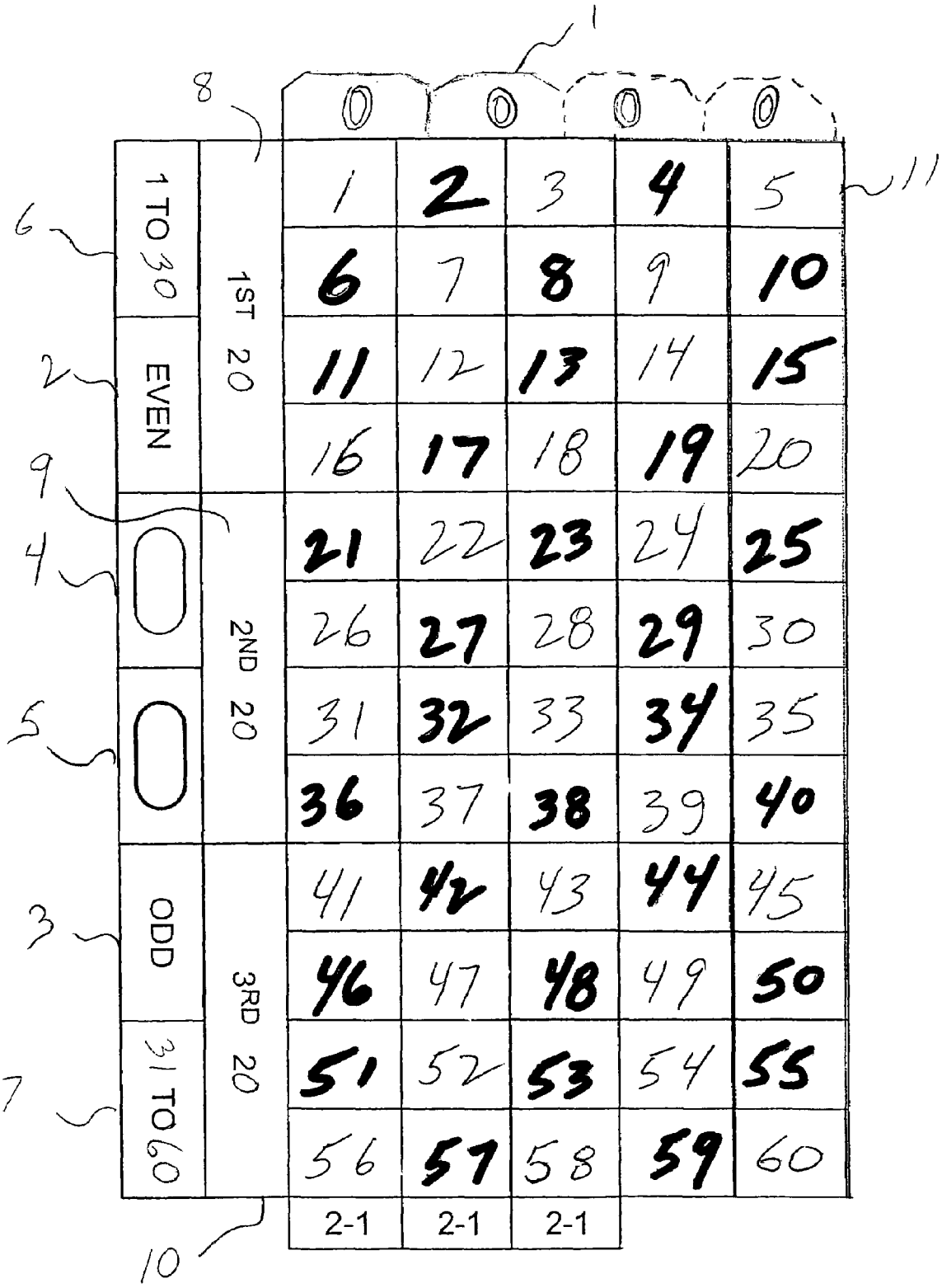
FIG. 4A shows a game surface according to the embodiment of FIG. 4 with a different color pattern of number values.

Without any limitation, as shown in FIG. 4A, it is understood that, individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 are associated with a first color (e.g., red), and individual number wagering areas corresponding to numbers 2, 4, 6, 8, 10, 11, 13, 15, 17, 19, 21, 23, 25, 27, 29, 32, 34, 36, 38, 40, 42, 44, 46, 48, 50, 51, 53, 55, 57 and 59 are associated with a second color (e.g., black).

FIGS. 5, 6, and 7 show example roulette wheel arrangements according to embodiments of the invention. As shown, each roulette wheel includes a plurality of pockets 12 disposed in a circumferential manner, for example the wheels shown in FIGS. 5-6 may have sixty four pockets.

As shown in FIG. 5, each of the pockets 12 correspond to either a house number 13, 113, 14, 114 or to one of the whole numbers from 1 to 60. Each of the whole numbers on the wheel is associated with a first color or a second color conforming to the association of numbers and colors on a game surface to be used with the particular wheel. It should be understood that while four house numbers (13, 113, 14, 114) are shown in the embodiments depicted in FIGS. 5, 6, it is understood that two diametrically opposed house numbers, (e.g., 14, 114) may be omitted, thus, leaving only two house numbers for these embodiments.

According to an embodiment of the invention, the pockets and corresponding numbers on the roulette wheel are arranged such that no two adjacent numbers on the roulette wheel are associated with a same color, are disposed in a same group on an associated game surface, are disposed in a same column on an associated game surface, are disposed in a same row on an associated game surface, or are disposed adjacent one another on an associated game surface. In terms of the game surface, two adjacent numbers may be considered as two numbers which are directly above or below one another (for example 4 and 9), side by side (for example 7 and 8) or directly diagonal from one another (for example 10 and 4).

According to a further embodiment of the invention, the pockets and corresponding numbers on the roulette wheel 100 as shown in FIG. 5, are arranged such that each number at a pocket location "i", i=1, . . . , 30 when traversing clockwise one half 99*a* of the roulette wheel beginning at a first pocket location 101 as shown in FIG. 5, and, a corresponding positioned pocket location "j", j=1, . . . , 30 (number) when traversing the roulette wheel counter-clockwise beginning at a corresponding first pocket location 201 the other half 99*b* of the roulette wheel will add up to sixty one for each pair of like positioned numbers. That is, $i_1+j_1=61$, $i_2+j_2=61$, . . . $i_{30}+j_{30}=61$ etc. For example, the following pairs of numbers on the roulette wheel arrangements shown in FIG. 5 meet this criteria: 49 and 12; 36 and 25; 5 and 56; 42 and 19; 33 and 28; 4 and 57; 41 and 20; 40 and 21; 7 and 54; 48 and 13, etc; . . . ; 1 and 60; 50 and 11; 37 and 24; and 8 and 53. Moreover, it is further shown that each corresponding positioned number pair that adds to 61 are of the same color, e.g., values 49 and 12, 36 and 25, etc.

Thus, as shown in FIG. 5, the pockets i=1, . . . , 30 when traversing the half 99*a* of the roulette wheel clockwise beginning at a first location 101 as shown in FIG. 5, may be arranged in the following clockwise sequence with respect to a corresponding number: a first house number, 49, 36, 5, 42, 33, 4, 41, 40, 7, 48, 39, 6, 45, 32 and 3, a second house number, 44, 31, 10, 47, 38, 9, 46, 35, 2, 43, 34, 1, 50, 37 and 8. Likewise, as shown in FIG. 5, the pockets j=1, . . . , 30 when traversing a second half of the roulette wheel counter-clockwise beginning at the first location 201, corresponding to the first location 101 as shown in FIG. 5, may be arranged in the following counter-clockwise sequence with respect to a corresponding $i^{th}$ pocket number: 12, 25, 56, 19, 28, 57, 20, 21, 54, 13, 22, 55, 16, 29 and 58, a third house number, 17, 30, 51, 14, 23, 52, 15, 26, 59, 18, 27, 60, 11, 24 and 53.

In this example roulette wheel arrangement shown in FIG. 5, the first number value, e.g., 49, placed in the one half 99*a* of the roulette wheel beginning at a first pocket location 101 corresponds to a location in Group 3, Col. 4 of the corresponding game surface board of FIG. 4; the second value is chosen to correspond to any different group and column number of the game board surface of FIG. 4, e.g., Group 2, Col., 1 and, is of the second color. The consecutive $i^{th}$ pocket number values at each location starting from location 101 in FIG. 5, conform to a repeating pattern of Group and Columns of the corresponding game board surface of FIG. 4, from left to right as follows:

| GROUP | Col. |
|---|---|
| 3 | 4 |
| 2 | 1 |
| 1 | 5 |
| 3 | 2 |
| 2 | 3 |
| 1 | 4 |
| 3 | 1 |
| 2 | 5 |
| 1 | 2 |
| : | : |
| : | : |

Likewise, in this example roulette wheel arrangement shown in FIG. 5, the first number value at the first pocket location 201 of the other half 99*b* of the roulette wheel is chosen such that the sum of that value and the number value at the corresponding location at the first half 99*a* of the roulette wheel is a value of 61, which for the example wheel shown in FIG. 5, is the value 12 corresponding to a location in Group 1, Col. 2 of the corresponding game surface board of FIG. 4; the next consecutive (second) value is chosen to correspond to a value that when added to a corresponding second value at the first half wheel 99*a* would equal 61 and this happens to correspond to a Group 2, col., 5 of the game board surface of FIG. 4, and, is of the second color. It is readily seen that the consecutive $j^{th}$ pocket number values at each location starting from location 201 in FIG. 5, conform to a repeating pattern of Group and Columns of the corresponding game board as follows:

| GROUP | Col. |
|---|---|
| 1 | 2 |
| 2 | 5 |
| 3 | 1 |
| 1 | 4 |
| 2 | 3 |
| 3 | 2 |
| 1 | 5 |
| 2 | 1 |
| 3 | 4 |
| : | : |
| : | : |

It is understood that the roulette wheel may comprise values according to similar repeating patterns that begin with any Group/Column combination. Thus, in another example embodiment for the arrangement of numbers in the roulette wheel 300 depicted in FIG. 6, the pockets i=1, . . . , 30 when traversing the half 199*a* of the roulette wheel clockwise beginning at a first location 301 as shown in FIG. 6, may be arranged in the following clockwise sequence with respect to a corresponding number: a first house number, 21, 52, 10, 39, 53, 1, 27, 45, 4, 33, 51, 7, 40, 49 and 13, a second house number, 31, 42, 20, 29, 43, 11, 37, 55, 14, 38, 56, 2, 35, 44, and 3. Likewise, as shown in FIG. 6, the pockets j=1, . . . , 30 when traversing a second half of the roulette wheel counter-clockwise beginning at the first location 401, corresponding to the first location 301 as shown in FIG. 6, may be arranged in the following counter-clockwise sequence with respect to a corresponding $i^{th}$ pocket number: 40, 9, 51, 22, 8, 60, 34, 16, 57, 28, 10, 54, 21, 12 and 48, a third house number, 30, 19, 41, 32, 18, 50, 24, 6, 47, 23, 5, 59, 26, 17 and 58.

In this example roulette wheel arrangement shown in FIG. 6, the first number value, e.g., 21, placed in the one half 199*a* of the roulette wheel beginning at a first pocket location 301 corresponds to a location in Group 2, Col. 1 of the corresponding game surface board of FIG. 4; the second value is chosen to correspond to any different group and column number of the game board surface of FIG. 4, e.g., Group 3, Col., 2 and, is of the second color. The consecutive $i^{th}$ pocket number values at each location starting from location 301 in FIG. 6, conform to a repeating pattern of Group and Columns of the corresponding game board surface of FIG. 4, from left to right as follows:

| GROUP | Col. |
|---|---|
| 2 | 1 |
| 3 | 2 |
| 1 | 5 |
| 2 | 4 |
| 3 | 3 |
| 1 | 1 |
| 2 | 2 |
| 3 | 5 |
| 1 | 4 |
| : | : |
| : | : |

Likewise, in this example roulette wheel arrangement shown in FIG. 6, the first number value at the first pocket location 401 of the other half 199*b* of the roulette wheel is chosen such that the sum of that value and the number value at the corresponding location at the first half 199*a* of the roulette wheel is a value of 61, which for the example wheel shown in FIG. 6, is the value 40 corresponding to a location in Group 2, Col. 5 of the corresponding game surface board of FIG. 4; the next consecutive (second) value is chosen to correspond to a value that when added to a corresponding second value at the first half wheel 199*a* would equal 61 and this happens to correspond to a Group 1, col., 4 of the game board surface of FIG. 4, and, is of the second color. It is readily seen that the consecutive $j^{th}$ pocket number values at each location starting from location 401 in FIG. 6, conform to a repeating pattern of Group and Columns of the corresponding game board as follows:

| GROUP | Col. |
|---|---|
| 2 | 5 |
| 1 | 4 |
| 3 | 1 |
| 2 | 2 |
| 1 | 3 |
| 3 | 5 |
| 2 | 4 |
| 1 | 1 |
| 3 | 2 |
| : | : |
| : | : |

As previously mentioned, in the embodiments of the roulette wheel 100 of FIGS. 5 and 300 of FIG. 6, while four house numbers have been shown, it is understood that wheel may be provisioned with less than four (4) house numbers as depicted. For example, in the example embodiment depicted in FIG. 5, the house numbers indicated as 14 and 114 may be omitted, and correspondingly, the game board surface in FIG. 4 will reflect only two house number wager areas. Likewise, in the example embodiment depicted in FIG. 6, the house numbers indicated as 214 and 314 may be omitted, and correspondingly, the game board surface in FIG. 4 will reflect only two house number wager areas.

A further example roulette wheel arrangement is now depicted as shown in FIG. 7. In FIG. 7, there is depicted a roulette wheel 500 having three (3) house numbers first house number 413, second house number 414, and third house number 415. In the sequence shown in FIG. 7, the pockets may be arranged in the following counter-clockwise sequence with respect to a corresponding number: a first house number, 3, 32, 45, 6, 39, 48, 7, 40, 41, 4, 33, 42, 5, 36, 49, 13, 22, 55, 16 and 29, second house number, 58, 17, 30, 51, 14, 23, 52, 15, 26, 59, 18, 27, 60, 11, 24, 53, 12, 25, 56 and 19, third house number, 28, 57, 20, 21, 54, 8, 37, 50, 1, 34, 43, 2, 35, 46, 9, 38, 47, 10, 31 and 44.

In this example roulette wheel arrangement shown in FIG. 7, a first number value, e.g., 3, at a first pocket location at the periphery of the wheel corresponds to a location in Group 1, Col. 3 of the corresponding game surface board of FIG. 4 taken from left to right; the second value in a counter-clockwise direction is chosen to correspond to any different group and column number of the game board surface of FIG. 4, e.g., Group 2, Col., 2 and, is of the second color. The consecutive $j^{th}$ pocket number values at each consecutive location starting from location 501 in FIG. 7, and traversing counter-clockwise, conform to a repeating pattern of Group and Columns of the corresponding game board surface of FIG. 4, from left to right as follows:

| GROUP | Col. |
|---|---|
| 1 | 3 |
| 2 | 2 |
| 3 | 5 |
| 1 | 1 |
| 2 | 4 |
| 3 | 3 |
| 1 | 2 |
| 2 | 5 |
| 3 | 1 |
| 1 | 4 |
| : | : |

It is also noted that if one traverses clockwise at number 58, (next to house number at 415) and traverses counter-clockwise the roulette wheel starting at number 3, and ignoring the house numbers, the sums of each pair of numbers equals 61 when one reaches 54 in the counter-clockwise direction. The numbers 54 to 12 in the counter-clockwise direction do not fit the pattern. Moreover, if one counts clockwise from number 3 and counter-clockwise from number 58, the sums of each pair of numbers equals 61, until one reaches number 7 in the counter-clockwise direction of 49 in the clockwise direction. However, if one starts from number 49 in the lower half and traverses in the clockwise direction, and one starts from 12 and traverses the roulette wheel in the counter-clockwise direction until the number 54 is reached, it is noted that the sum of each pair of numbers also equals 61. Nevertheless, these remaining numbers starting from 49 in the lower half until "7" in a clockwise direction and starting from 12 until 54 in the counterclockwise direction need not add up to 61, as long as the remaining criteria described herein are met.

Although not shown, it is understood that in the embodiments depicted in FIGS. 4-7, the total number of arrangements of numbers (indicia) on the roulette wheel is 3!×5! or approximately 720 arrangements as there are six (6) Group permutations (1,2,3; 1,3,2; 2,1,3; 2,3,1; 3,1,2; and 3,2,1 and 120 column permutations (1,2,3,4,5; 1,2,3,5,4; 1,2,4,3,5; 1,2, 4,5,3; etc.), with each arrangement possibly including the addition of two, three or four house numbers. However, it should be understood that generally, the game surface may be arranged in other forms, e.g., a different number of columns, groups and rows as long as the criteria is met that the pockets and corresponding numbers on the roulette wheel are arranged such that no two adjacent numbers on the roulette wheel are associated with a same color, are disposed in a same group on the associated game surface, are disposed in a same column on the associated game surface, are disposed in a same row on the associated game surface, or are disposed adjacent one another on the associated game surface.

A further advantage of a roulette game surface and wheel arrangement according to an embodiment of the invention is that the arrangement of numbers, colors and odd and even numbers is significantly more balanced than in the prior art arrangements.

Figure 2:
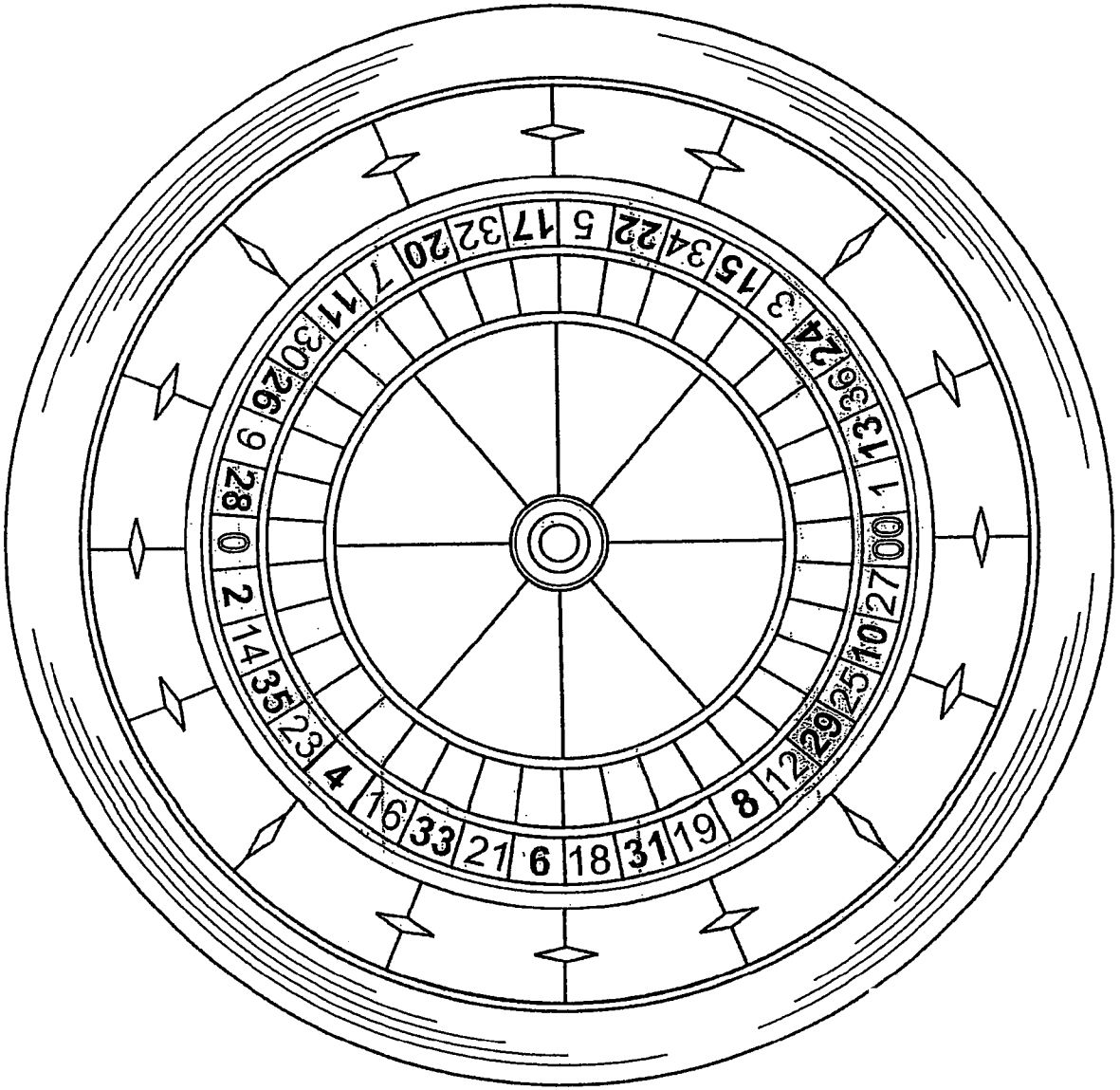
FIG. 2 (Prior Art)
FIG. 2 shows a prior art American wheel arrangement for a use with the prior art game surface shown in FIG. 1.
Figure 3:
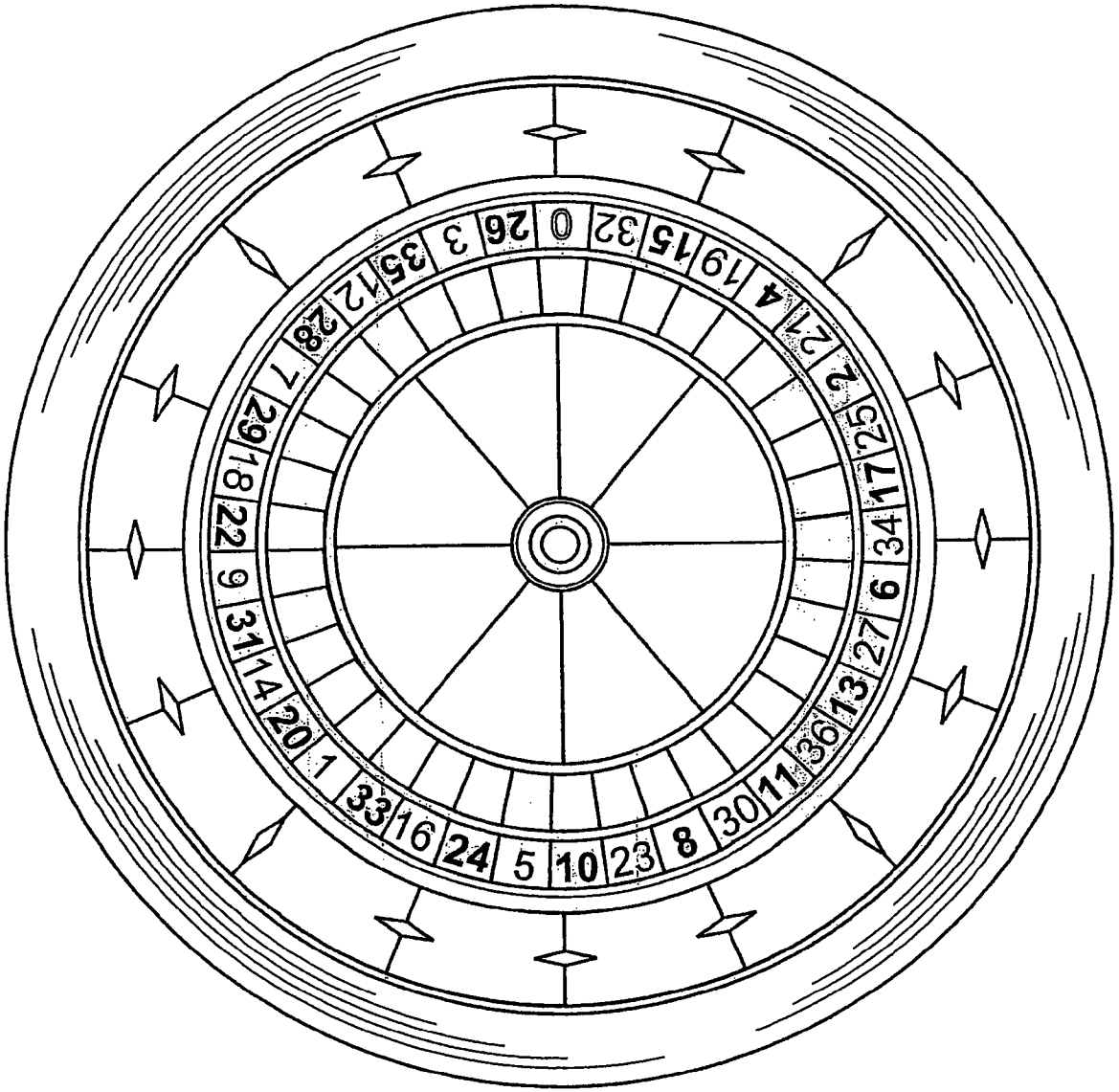
FIG. 3 (Prior Art)
FIG. 3 shows a prior art European wheel arrangement for a use with the prior art game surface shown in FIG. 1.

In the prior art arrangements shown in FIGS. 1-3, the sum of the eight odd black numbers (11, 13, 15, 17, 29, 31, 33 and 35) equals 184, and the sum of the ten odd red numbers (1, 3, 5, 7, 9, 19, 21, 23, 25, and 27) equals 140, giving a total of 324 as the sum of the odd numbers. The sum of the ten even black numbers in the prior art arrangements shown in FIGS. 1-3 (2, 4, 6, 8, 10, 20, 22, 24, 26, and 28) equals 150 and the sum of the eight even red numbers (12, 14, 16, 18, 30, 32, 34 and 36) equals 192, giving a total of 342 as the sum of the even numbers. The sum of the eight black odd numbers (184) and the ten black even numbers (150) equals 334, while the sum of the ten red odd numbers (140) and the eight red even numbers (192) is only 332 in the prior art arrangements.

In the arrangements shown in FIGS. 4,5, for example, the sum of the fifteen odd black numbers (1, 3, 5, 7, 9, 31, 33, 35, 37, 39, 41, 43, 45, 47 and 49,) equals 425, and the sum of the fifteen odd red numbers (11, 13, 15, 17, 19, 21, 23, 25, 27, 29, 51, 53, 55, 57 and 59) equals 475, giving a total of 900 as the sum of the odd numbers. The sum of the fifteen even black numbers in the arrangements shown in FIGS. 4-5 (12, 14, 16, 18, 20, 22, 24, 26, 28, 30, 52, 54, 56, 58 and 60) equals 490 and the sum of the fifteen even red numbers (2, 4, 6, 8, 10, 32, 34, 36, 38, 40, 42, 44, 46, 48 and 50) equals 440, giving a total of 930 as the sum of the even numbers. However, the sum of the fifteen red even number values (440) and fifteen red odd number values (475) (which is equal to 915) is equal to the sum of the fifteen black even numbers (490) and fifteen black odd numbers (425). Additionally, from the perspective of the roulette wheel, looking at the top one quarter of the wheel labeled (quadrant) I of the wheel 100 depicted in FIG. 5, the number values are distributed such that the sum of the fifteen consecutive alternating red even and black odd numbers traversing clockwise (i.e., 49, 36, 5, 42, 33, 4, 41, 40, 7, 48, 39, 6, 45, 32 and 3) is 430 (208 black even and 222 black odd); and likewise, the sum of the fifteen consecutive alternating red even and black odd numbers in the other top half quadrant II of the wheel traversing clockwise from the second house number is 435 (232 red even numbers and 203 black odd numbers); and likewise, the sum of the fifteen consecutive alternating red odd and black even numbers in the bottom quadrant III of the wheel traversing counter-clockwise from the first house number is 485 (219 red odd numbers and 266 black even numbers) and the sum of the fifteen consecutive alternating red odd and black even numbers in the bottom quadrant IV of the wheel traversing counter-clockwise from the house number equals 480 (256 red odd and 224 black even). Thus, it readily follows that the sum of the fifteen consecutive number values in the quadrant I of the wheel added to the sum of the fifteen consecutive number values in the quadrant III of the wheel is 915, which is the same as the sum of the fifteen consecutive number values in the quadrant II of the wheel added to the sum of the fifteen consecutive number values in the quadrant IV of the wheel (915). Thus, the wheel is perfectly balanced.

Thus, as shown in FIG. 5, the sum of the numbers between the two house numbers 14, 114 on one side of wheel is exactly equal to the sum of the numbers between the two house numbers 14, 114 on the other side of the wheel, 915, evidencing the perfect balance of numbers on a wheel arrangement according to an embodiment of the invention.

Moreover, as shown in the embodiment of the roulette wheel depicted in FIG. 5, There is no place on the roulette wheel where two odd numbers or two even numbers are grouped together unlike the prior art arrangements where two odd numbers or two even numbers are grouped around the house number (0 or 00). For example, in the prior art American roulette wheel shown in FIG. 2, the two even numbers 28 and 2 are separated by the house number 0 and the two odd numbers 27 and 1 are separated by the house number 00.

In roulette wheel arrangement depicted in FIG. 6, according to an embodiment of the invention, however, a pair of adjacent odd numbers and a pair of adjacent even numbers may be positioned diametrically opposite one another on the wheel at positions disposed away from the house number. For example in the wheel shown in FIG. 6, the pair of adjacent even numbers 48, is located directly opposite the pair of adjacent odd numbers 31, 13.

As used herein, the term divisible or evenly divisible means that upon performing the division, there is no remainder, Accordingly, while several embodiments of the present invention have been shown and described, it is obvious that many changes and modifications may be made thereunto without departing from the spirit and scope of the invention. For example, the concept of the super roulette wheel of the invention as described herein may be adapted for use in other like gaming devices, e.g., a pin-wheel game.

What is claimed is:

1. A method for arranging indicia on a game surface and on an associated roulette wheel for a roulette game, the method comprising the steps of:

a) providing a game surface;

b) providing one roulette wheel;

c) arranging indicia indicating one or more house numbers on the game surface arranged symmetrically spaced on the roulette wheel;

d) arranging indicia indicating sixty whole numbers consisting of numbers 1 through 60, wherein one half of the whole numbers are associated with a first color and a remaining half of the whole numbers are associated with a second color, on the game surface in a matrix of five columns and twelve rows, the whole numbers being arranged in ascending order beginning from a top left corner and proceeding from left to right across the rows;

wherein the whole numbers are arranged in three groups of twenty numbers each, a first group comprising the numbers 1 through 20, a second group comprising the numbers 21 through 40 and a third group comprising the numbers 41 through 60; and wherein each of said first, second and third group comprise five even numbers associated with the first color, five odd numbers associated with first color, five even numbers associated with the second color and five odd numbers associated with the second color;

e) arranging indicia indicating the one or more house numbers on the roulette wheel; and f) arranging indicia indicating each of the sixty whole numbers on the roulette wheel in a circumferential manner by:

selecting a first whole number associated with the first color or the second color and disposed in one of the five columns and one of the three groups and indicating the first whole number on the roulette wheel;

selecting a second whole number associated with another of the first color or the second color and disposed in another of the three columns and another of the three groups and indicating the second whole number on the roulette wheel adjacent to the first whole number;

selecting a third whole number associated with the first color or the second color and disposed in one of the five columns not previously selected and in another of the three groups not previously selected and indicating the third whole number on the roulette wheel adjacent to the second whole number on the roulette wheel;

selecting a fourth whole number associated with the first color or the second color and disposed in another of the five columns not previously selected but in the first group previously selected and indicating the fourth whole number on the roulette wheel adjacent to the third whole number on the roulette wheel;

selecting a fifth whole number associated with the first color or the second color and disposed in one of the five columns not previously selected and in the second of the three groups previously selected, and indicating the fifth whole number on the roulette wheel adjacent to the fourth whole number on the roulette wheel, and repeating this pattern on the roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface, wherein for at least about two-thirds of the indicia numbers on the roulette wheel, each indicia number when traversing the roulette wheel clockwise beginning at a first pocket location of a first half of the roulette wheel and a corresponding positioned number when traversing the roulette wheel counter-clockwise beginning at the first pocket location of the second half of the roulette wheel will add up to sixty one for each pair of like positioned numbers.

2. The method game according to claim 1, wherein each corresponding positioned number pair that have number values adding up to 61 are of the same color.

3. The method according to claim 1, having two or four house numbers.

4. The method according to claim 1 or 3 where each indicia number when traversing the roulette wheel clockwise at a first pocket location of a first half of the roulette wheel and a corresponding positioned number when traversing the roulette wheel counter-clockwise beginning at the first pocket location of the second half of the roulette wheel will add up to 61 for each pair of like positioned numbers.

5. A roulette game apparatus comprising:

a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 30;

(vii) a high number wagering area corresponding to a whole number from 31 to 60;

(viii) a first other wagering area corresponding to a whole number from 1 to 20;

(ix) a second other wagering area corresponding to a whole number from 21 to 40;

(x) a third other wagering area corresponding to a whole number from 41 to 60; and (xi) sixty individual number wagering areas, each corresponding to a whole number consisting of the numbers from 1 to 60, said sixty individual number wagering areas arranged in ascending order from left to right in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 are associated with said first color, and individual number wagering areas corresponding to numbers 2, 4, 6, 8, 10, 11, 13, 15, 17, 19, 21, 23, 25, 27, 29, 32, 34, 36, 38, 40, 42, 44, 46, 48, 50, 51, 53, 55, 57 and 59 are associated with said second color; and b) one roulette wheel comprising a plurality of pockets disposed in a circumferential manner, each of said pockets corresponding to a house number or to a whole number from 1 to 60, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface and such that the roulette wheel is arranged such that a first whole number is selected associated with the first color or the second color and disposed in one of the five columns and one of the three groups and indicating the first whole number on the roulette wheel; a second whole number is selected associated with another of the first color or the second color and disposed in another of the five columns and another of the three groups and indicating the second whole number on the roulette wheel adjacent to the first whole number, a third whole number is selected associated with the first color or the second color and disposed in one of the five columns not previously selected and in another of the three groups and indicating the third whole number on the roulette wheel adjacent to the second whole number on the roulette wheel, a fourth whole number is selected associated with the first color or the second color and disposed in another of the five columns not previously selected but in the first group previously selected and indicating the fourth whole number on the roulette wheel adjacent to the third whole number on the roulette wheel, and a fifth whole number is selected associated with the first color or the second color and disposed in one of the five columns not previously selected, but in the second group previously selected and indicating the fifth whole number on the roulette wheel adjacent to the fourth whole number on the roulette wheel and repeating this pattern on the roulette wheel until all 60 numbers are selected on the roulette wheel.

6. The roulette game apparatus according to claim 5 wherein for at least about two-thirds of the number indicia or the roulette wheel, each consecutive number when traversing the roulette wheel clockwise beginning at a first pocket location of a first half of the roulette wheel and a corresponding positioned number when traversing the roulette wheel counter-clockwise beginning at a like first pocket location of the second half of the roulette wheel will add up to sixty one for each pair of like positioned numbers.

7. The roulette game apparatus according to claim 5 wherein each consecutive number when traversing the roulette wheel beginning at a first pocket location of a first half of the roulette and a corresponding positioned number when traversing the roulette wheel counter-clockwise beginning at a first pocket location of the second half of the roulette wheel adds up to 61 for each pair of like positioned numbers.

8. The roulette game apparatus according to claim 5, wherein said pockets are arranged in the following clockwise sequence with respect to a corresponding number: a first house number, 49, 36, 5, 42, 33, 4, 41, 40, 7, 48, 39, 6, 45, 32 and 3, an optional second house number, 44, 31, 10, 47, 38, 9, 46, 35, 2, 43, 34, 1, 50, 37 and 8, a third house number, 53, 24, 11, 60, 27, 18, 59, 26, 15, 52, 23, 14, 51, 30, 17, an optional fourth house number, 58, 29, 16, 55, 22, 13, 54, 21, 20, 57, 28, 19, 56, 25 and 12.

9. The roulette game apparatus according to claim 8, wherein said second and fourth house numbers are omitted.

10. The roulette game apparatus according to claim 5, comprising two, three or four additional house numbers.

11. The roulette game apparatus according to claim 10, comprising three house numbers evenly distributed about the circumference of said wheel such that 20 numbers are present between any two house numbers.

12. The roulette game apparatus according to claim 5, wherein each corresponding positioned number pair that have number values adding up to 61 are of the same color.

13. A roulette game apparatus comprising:

a) a game surface comprising:

(i) one or more house number wagering areas;

(ii) an even number wagering area (iii) an odd number wagering area (iv) a first color wagering area;

(v) a second color wagering area (vi) a low number wagering area corresponding to a whole number from 1 to 30;

(vii) a high number wagering area corresponding to a whole number from 31 to 60;

(viii) a first other wagering area corresponding to a whole number from 1 to 20;

(ix) a second other wagering area corresponding to a whole number from 21 to 40;

(x) a third other wagering area corresponding to whole number from 41 to 60; and (xi) sixty individual number wagering areas, each corresponding to a whole number consisting of the numbers from 1 to 60, said sixty individual number wagering areas arranged in ascending order from left to right in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 are associated with said first color, and individual number wagering areas corresponding to numbers 2, 5, 6, 8, 10, 11, 13, 15, 17, 19, 21, 23, 25, 27, 29, 32, 34, 36, 38, 40, 42, 44, 46, 48, 50, 51, 53, 55, 57 and 59 are associated with said second color; and b) one roulette wheel comprising a plurality of pockets disposed in a circumferential manner, each of said pockets corresponding to a house number or to a whole number from 1 to 60, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface and, such that there are three pockets having house numbers distributed evenly about said circumference.

14. The roulette game apparatus according to claim 13, wherein said pockets are arranged in the following counter clockwise sequence with respect to a corresponding number: a first house number, 3, 32, 45, 6, 39, 48, 7, 40, 41, 4, 33, 42, 5, 36, 49, 13, 22, 55, 16 and 29, second house number, 58, 17, 30, 51, 14, 23, 52, 15, 26, 59, 18, 27, 60, 11, 24, 53, 12, 25, 56 and 19, third house number, 28, 57, 20, 21, 54, 8, 37, 50, 1, 34, 43, 2, 35, 46, 9, 38, 47, 10, 31 and 44.

15. The roulette game apparatus according to claim 14, wherein each of said plurality of pockets include a number value such that, when added to a number of another pocket having a number value of like color, add up to sixty one.

16. The roulette game apparatus comprising:

a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 30;

(vii) a high number wagering area corresponding to a whole number from 31 to 60;

(viii) a first other wagering area corresponding to a whole number from 1 to 20;

(ix) a second other wagering area corresponding to a whole number from 21 to 40;

(x) a third other wagering area corresponding to a whole number from 41 to 60; and (xi) sixty individual number wagering areas, each corresponding to a whole number consisting of the numbers from 1 to 60, said sixty individual number wagering areas arranged in ascending order from left to right in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to thirty of the sixty numbers associated with said first color, and individual number wagering areas corresponding to the remaining numbers are associated with said second color; and b) a roulette wheel comprising a plurality of pockets disposed in a circumferential manner, each of said pockets corresponding to a house number or to a whole number from 1 to 60, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface.

17. The roulette game apparatus according to claim 16 additionally comprising one to four house numbers on the roulette wheel evenly spaced apart.

* * * * *